US010000964B2

(12) United States Patent
Lenz et al.

(10) Patent No.: US 10,000,964 B2
(45) Date of Patent: Jun. 19, 2018

(54) CONNECTORS FOR SPACERS OF INSULATING GLASS UNITS AND SPACER COMPRISING A CONNECTOR FOR AN INSULATING GLASS UNIT

(75) Inventors: Joerg Lenz, Kassel (DE); Peter Cempulik, Kassel (DE); Thorsten Siodla, Kassel (DE); Nils Schedukat, Kassel (DE); Ferdinand Bebber, Kassel (DE); Thomas Orth, Lohfeld (DE); Norbert Deckers, Kassel (DE)

(73) Assignee: TECHNOFORM GLASS INSULATION HOLDING GMBH, Kassel (DE)

( * ) Notice: Subject to any disclaimer, the term of this patent is extended or adjusted under 35 U.S.C. 154(b) by 947 days.

(21) Appl. No.: 13/980,689

(22) PCT Filed: Jan. 20, 2012

(86) PCT No.: PCT/EP2012/000264
§ 371 (c)(1),
(2), (4) Date: Oct. 31, 2013

(87) PCT Pub. No.: WO2012/098008
PCT Pub. Date: Jul. 26, 2012

(65) Prior Publication Data

US 2014/0112714 A1 Apr. 24, 2014

(30) Foreign Application Priority Data

Jan. 21, 2011 (DE) ..... 10 2011 009 090

(51) Int. Cl.
*E06B 3/66* (2006.01)
*E06B 3/96* (2006.01)
(Continued)

(52) U.S. Cl.
CPC ..... *E06B 3/667* (2013.01); *E06B 3/9681* (2013.01); *E06B 3/972* (2013.01); *Y10T 403/557* (2015.01);
(Continued)

(58) Field of Classification Search
CPC .. E06B 3/667; E06B 3/67308; E06B 3/67313; E06B 3/9681; E06B 3/972;
(Continued)

(56) References Cited

U.S. PATENT DOCUMENTS 2,996,159 A * 8/1961 Casebolt ..... E06B 3/9725 403/280
3,485,519 A * 12/1969 Chiu ..... F16B 12/40 403/172
(Continued)

FOREIGN PATENT DOCUMENTS

CN 101421482 A 4/2009
CN 101517187 A 8/2009
(Continued)

*Primary Examiner* — Ryan D Kwiecinski
(74) *Attorney, Agent, or Firm* — J-TEK Law PLLC; Jeffrey D. Tekanic; Scott T. Wakeman

(57) ABSTRACT

A technique for improving the retention force between a connector (10, 11, 12, 13, 14, 15, 16, 17, 100, 101) and a spacer (1) for insulating glass units is disclosed.

21 Claims, 13 Drawing Sheets

(51) Int. Cl.
*E06B 3/667* (2006.01)
*E06B 3/968* (2006.01)
*E06B 3/972* (2006.01)

(52) U.S. Cl.
CPC ..... *Y10T 403/559* (2015.01); *Y10T 403/7005* (2015.01)

(58) Field of Classification Search
CPC ..... Y10T 403/55; Y10T 403/557; Y10T 403/559; F16B 7/0413
USPC ..... 52/656.9, 786.13; 403/292, 297, 298
See application file for complete search history.

(56) References Cited

U.S. PATENT DOCUMENTS 3,782,054 A * 1/1974 Goss, Jr. ..... E06B 3/9682 40/782
3,822,101 A * 7/1974 Schneider ..... E06B 3/9725 403/295
3,829,226 A * 8/1974 Kreusel ..... E06B 3/9681 403/295
3,954,345 A * 5/1976 Morris ..... F16B 12/24 403/297
4,124,322 A * 11/1978 Parisien ..... E06B 3/9648 160/381
4,974,352 A * 12/1990 Shwu-Jen ..... A47G 1/10 40/783
5,083,882 A * 1/1992 Liu ..... E04B 1/585 403/295
5,127,762 A * 7/1992 Havlovitz ..... B62B 5/06 403/108
5,560,731 A * 10/1996 Kronenberg ..... E06B 3/667 403/292
5,642,957 A * 7/1997 Lange ..... F16B 7/0413 403/292
5,657,604 A * 8/1997 Malott ..... F16B 7/0473 403/252
5,820,292 A * 10/1998 Fremstad ..... A47G 1/10 403/403
6,339,909 B1 * 1/2002 Brunnhofer ..... E06B 3/66319 428/34
6,568,873 B1 * 5/2003 Peterson ..... E06B 3/667 403/300
7,757,455 B2 7/2010 Gallagher
8,240,107 B2 8/2012 Gallagher
2002/0102127 A1 8/2002 Loh
2002/0162936 A1 * 11/2002 Mellardo ..... B01F 7/00741 248/562
2004/0104319 A1 * 6/2004 Dean ..... F16B 7/025 248/146
2009/0129857 A1 5/2009 Strohheker
2010/0074679 A1 * 3/2010 Kronenberg ..... E06B 3/667 403/298
2010/0192508 A1 8/2010 Subra
2010/0202824 A1 8/2010 Subra
2016/0201323 A1 * 7/2016 Huwer ..... E04B 9/10 403/292

FOREIGN PATENT DOCUMENTS

CN 101815840 A 8/2010
DE 2461474 A1 * 8/1975 ..... F16B 7/0446
DE 19514752 A1 * 10/1996 ..... F16B 7/025
DE 10 2006 009 779 A1 9/2007
DE 10 2009 003 869 A1 11/2010
EP 1227210 A2 7/2002
EP 1 785 575 A2 5/2007
EP 1910639 B1 11/2010
WO 2008119461 A1 10/2008

* cited by examiner x
z
y a)
128
126
126z
127
b)
z
y
c)
128
126
126z
127
d)
127z
126z Prior Art Prior Art Prior Art

CONNECTORS FOR SPACERS OF INSULATING GLASS UNITS AND SPACER COMPRISING A CONNECTOR FOR AN INSULATING GLASS UNIT

CROSS-REFERENCE

This application is the U.S. National Stage of International Application No. PCT/EP2012/000264 filed on Jan. 20, 2012, which claims priority to German patent application no. 10 2011 009 090.8 filed on Jan. 21, 2011.

TECHNICAL FIELD

The present invention relates to connectors for spacers of insulating glass units, and a spacer assembly comprising a connector for an insulating glass unit.

RELATED ART

It is known in the field of insulating glass units, which will also be referred to as multi-pane insulating glass units (MIG units), to separate the panes via spacers.

Such spacers are usually made of metal or metal-plastic composite materials. The spacers are inserted such that they are arranged between the panes in the form of a frame at the peripheral edge of the same and, in combination with other sealing materials, seal the space between the panes. In MIG units, the space between the panes is typically filled with thermally insulating gases such as, e.g., argon, and it is important to maintain the leak tightness of the space between the panes over a long period of time.

Typically, the spacer frames are either made of four spacer parts connected via a corner connector, or a single spacer part bent into the shape of a frame, the open ends of which are then connected via a single linear connector (see, for example, FIG. 11 of EP 1 910 639 B1).

Metal-plastic spacers as the ones shown, for example, in FIG. 1 of EP 1 910 639 B1 are usually manufactured by extrusion, and are shipped as bars having a length of, e.g., 6 m. The spacers are then cut to the required length and bent into shape by the manufacturer of the MIG unit. The bars are often shipped with a linear connector already inserted on one side. Spacers having such an already inserted connector may, however, only be processed a long time after they have been shipped to the customer. The linear connectors are typically made of either plastic or metal.

With already inserted connectors made of plastic, there is often the problem that the retention force drops significantly after only a relatively short period of several hours. With already inserted connectors made of metal, there is often the problem that a clearance is produced.

An example of a linear connector made of metal is disclosed, e.g., in WO 2008/119461 A1 (US 2010/074679 A1). An example of a linear connector made of plastic is disclosed, e.g., in EP 1 227 210 A2 (US 2002/0102127 A1).

FIG. 13 shows a linear connector made of metal, which is known from US 2010/074679 A1, in a plan view in a), in a sectional plan view in a state in which it is inserted into an open end of a spacer in b), and in a side view in the inserted state in c).

DE 10 2009 003 869 A1 discloses a connector for spacers having longitudinal side edges biased by spring elements to the lateral outer side. U.S. Pat. No. 5,642,957 discloses a linear spacer connector of metal having two separate parts which can be pressed apart after insertion in both spacer ends.

SUMMARY

In one aspect of the present teachings, connectors are disclosed that improve the durability of the connection between the spacer and the inserted connector.

The teaching of the present application can be e.g. summarized as a connector for a spacer for insulating glass units, the spacer extending in a longitudinal direction with a constant cross-section in a cutting plane perpendicular to the longitudinal direction such that the spacer encloses an interior cavity, and being formed of plastic at least on the inner side enclosing the interior cavity, comprising a first connector section adapted to be inserted into the interior cavity of a spacer along the longitudinal direction, and a second connector section adapted to be inserted into the interior cavity of a spacer along the longitudinal direction, wherein the first connector section and the second connector section are successively disposed along a center axis extending in the longitudinal direction, and the first connector section is adapted to be held in the spacer by contact with the inner side of the spacer enclosing the interior cavity after insertion, wherein the first connector section includes two sub-sections having a toothing on their outer side and being moveable relative to each other such that at least a portion of the toothing is moved away from a plane which includes the center axis by a corresponding relative motion.

BRIEF DESCRIPTION OF THE DRAWINGS

Further advantages and useful embodiments may be taken from the description of embodiments with reference to the figures, in which.

DETAILED DESCRIPTION OF THE INVENTION

In the figures and the description, like elements are denoted by like reference numbers, and their description is not repeated for every embodiment.

Figure 1:
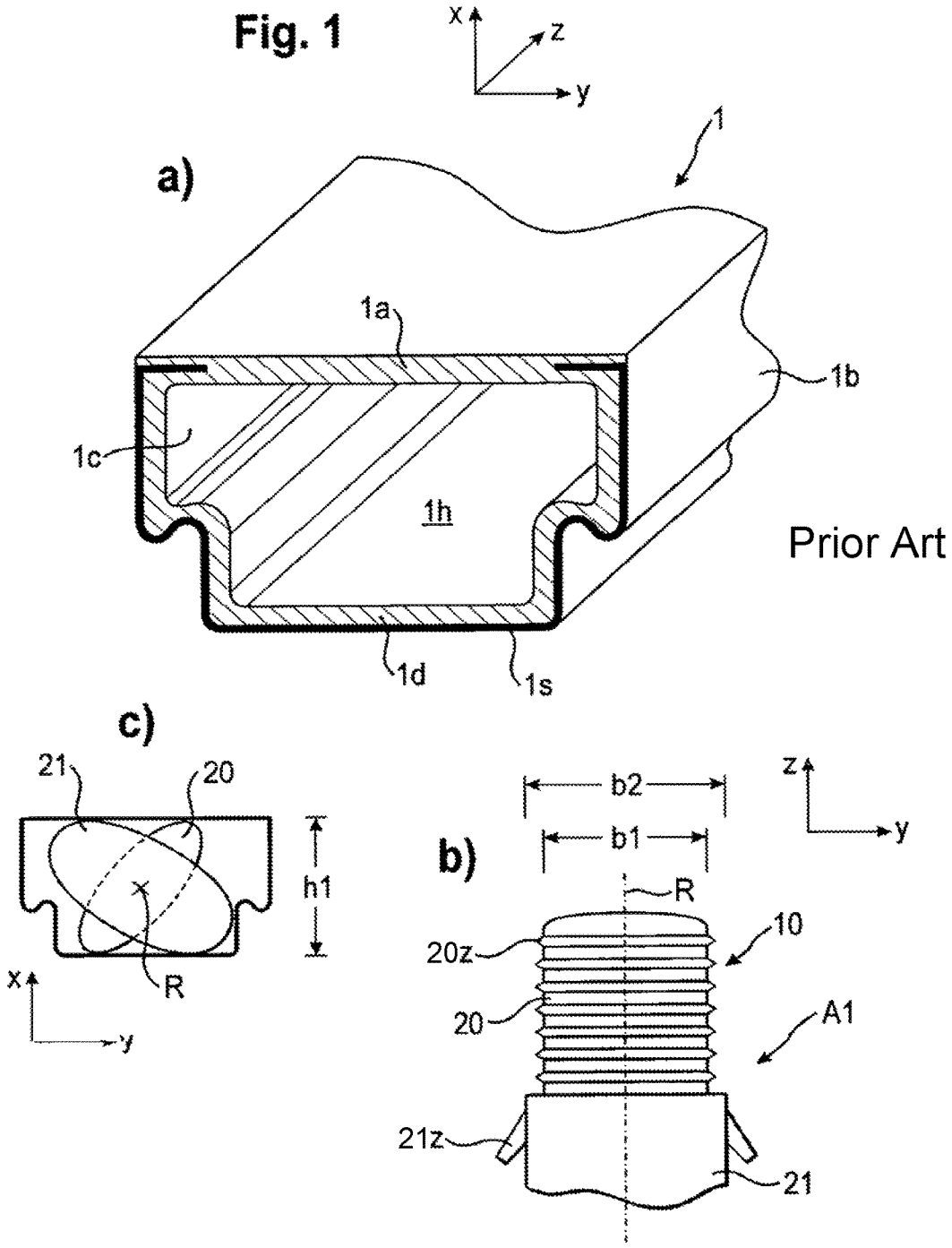
FIG. 1 shows a perspective sectional view of a spacer in a), a plan view of a part of a first embodiment of a connector in b), and a schematic sectional view of the first embodiment of the connector in a state in which it is inserted into a spacer in c)

FIG. 1*a*) shows a perspective sectional view of a spacer. FIG. 1 of EP 1 910 639 B1 shows how such a spacer is inserted between two panes in the assembled state. The spacer 1 extends in a longitudinal direction z and has a constant cross-section in a plane (x-y) perpendicular to the longitudinal direction z. The spacer 1 typically includes a wall 1*a*, which is permeable to gas due to a perforation or the like and faces the space between the panes in the assembled state, and two side walls 1*b*, 1*c* facing the panes in the assembled state and an additional wall 1*d* facing away from the space between the panes in the assembled state. The walls enclose an interior cavity 1*h*. A diffusion barrier layer is made of, e.g., metal is typically formed in or on the walls 1*b*, 1*c*, 1*d* as shown to provide the gas diffusion tightness. The interior cavity 1*h* has a height h1 in the direction x parallel to the panes, as shown in FIG. 1*c*).

Figure 13:
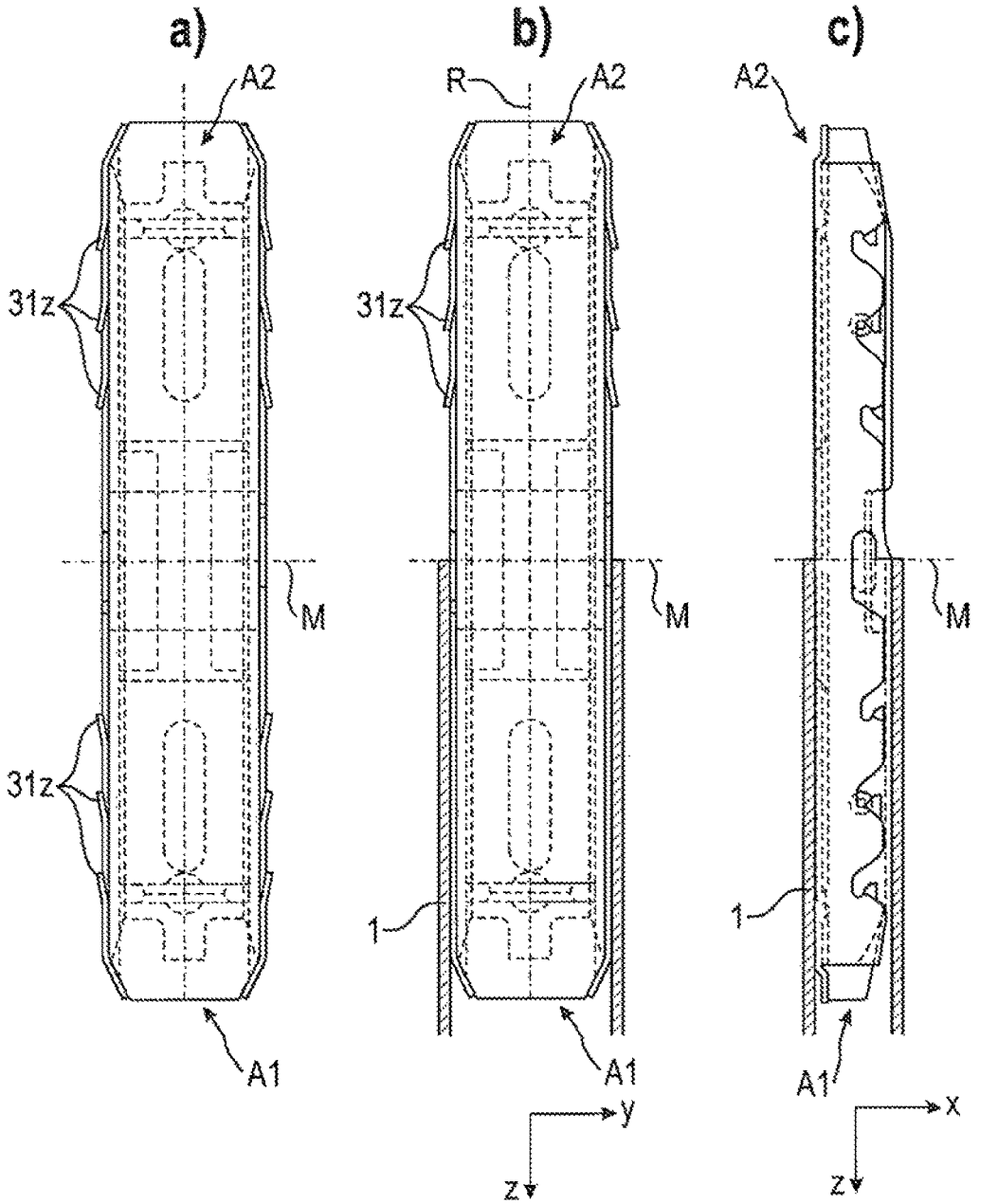
FIG. 13 shows a prior art connector in a plan view in a), in a state in which it is inserted into an open end of a spacer in a plan view in b) and in a side view in c).

As shown in FIG. 13, linear connectors typically include two sections A1 and A2 successively disposed, i.e. arranged one after the other along a center axis R, wherein the first section A1 is inserted into an open end of a spacer 1, and the other section is inserted into the other open end of the spacer 1 bent into the shape of a frame. The sections A1, A2 are usually of the same length and symmetrical with respect to the corresponding middle line M in plan view and in side view.

A section A1 of a first embodiment of a connector 10 is shown in plan view in FIG. 1*b*). The first section A1 has a first sub-section 20 and a second sub-section 21 successively disposed along the longitudinal direction z. The first and second sub-sections 20, 21 are connected to each other such that they may rotate relative to each other with respect to a rotational axis R extending along the longitudinal direction z. The first sub-section 20 has an oval shape having a maximum width b1 in the cross-section perpendicular to the rotational axis R (longitudinal direction z). The second sub-section 21 has, e.g., a rectangular cross-section or, as shown in FIG. 1*c*), an oval-shaped cross-section having a maximum width b2 greater than the width b1 in the cross-section perpendicular to the rotational axis R (longitudinal direction z). The cross-section of the second sub-section 21 is dimensioned similar to a conventional section for insertion according to the prior art, but shorter, such that it may be inserted along the longitudinal direction z into the interior cavity of the spacer 1 for which the connector 10 is provided in the known manner.

FIG. 1*c*) is a schematic illustration of the interior cavity 1*a* of the spacer 1.

The width b1 of the first sub-section 20 is dimensioned such that it is greater than the height h1 of the interior cavity 1*h*. The width b1 of the sub-section 20 is dimensioned such that (taking into account manufacturing tolerances) it is greater than h1 by 0.5 to 3 mm (preferably 1 mm).

Projections/teeth 20*z* are provided on (around) the outer walls of the first sub-section 20 for forming a spike connection with the inner wall of the spacer 1. A conventional insertion toothing 21*z* is provided on the second sub-section 21.

The first section A1 has two sub-sections 20, 21 formed such that they may be rotated relative to each other with respect to the rotational axis R after they have been inserted into the spacer 1 (e.g., by means of an inserted tool). Thereby, the first section A1 may be inserted into the space (internal cavity) 1*h* along the longitudinal direction z, while the two maximum widths b1, b2 of the sub-sections 20, 21 are either substantially aligned flush with each other, or are tilted by an angle significantly smaller than 90° relative to each other. After insertion, the two sub-sections 20 21 are rotated relative to each other with respect to the axis R. That means, the connector is constructed such that an external manipulation of/external application of force to (relative movement by rotation of) the sub-sections 20, 21 in the inserted state of the first section A1, in which the first section A1 has been inserted into the interior cavity/space 1*h* of the spacer (and before the second section A2 is fully inserted into the spacer), is enabled. More specifically, the first sub-section 20 is rotated relative to the second sub-section 21 and the spacer 1, such that it becomes tightly wedged to (against) the interior wall of the spacer 1 and at least a portion of the teeth 20*z* cuts into the interior wall.

In the embodiment shown in FIGS. 1*b*) and 1*c*), a tight wedging to or a strong cutting of the connector into the interior wall of the spacer 1 is achieved by a relative motion of the two subsections 20 21 of the inserted first section A1. More specifically, a portion of the teeth 20*z* and one or more of the teeth 21*z* are each moved away from a plane extending in the transverse direction y and including the center axis R. In this manner, one end (first section A1) the connector may be inserted into the spacer and connected to the spacer in a durable manner after the manufacture of the spacer, e.g. at the factory of the spacer manufacturer.

The other section A2 of the connector, which is not shown in FIG. 1, may be formed for insertion into the other open end of the bent spacer frame in the known manner.

With this durable connection, it becomes possible to store the bars of the spacers over long periods of time without the connection between the already inserted connector and the spacer becoming loose. In particular, it can be assured that the commonly required extraction forces for the connector of 80 to 150 N (8 to 15 kg) can be provided and, if necessary, exceeded.

Figure 2:
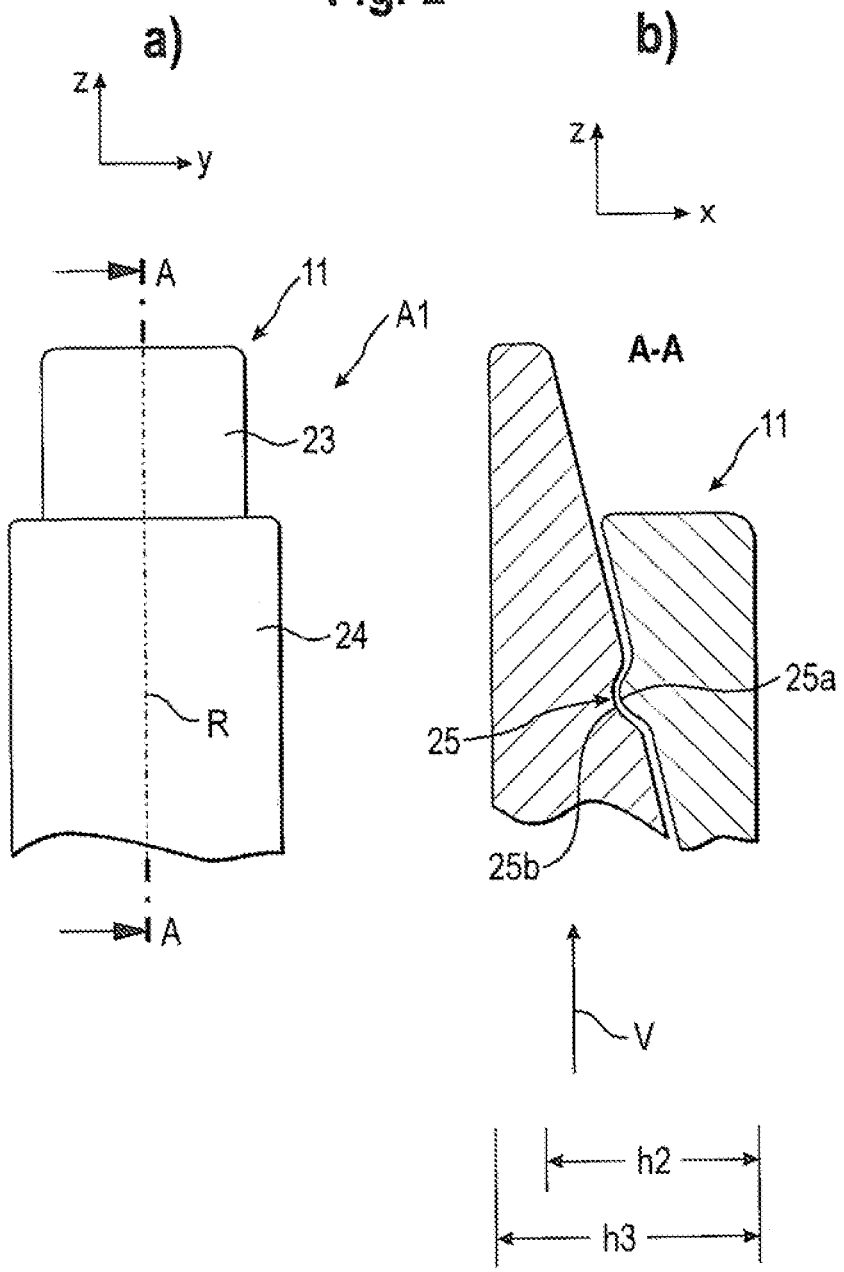
FIG. 2 shows a plan view of a second embodiment of a connector in a), and a sectional view along the cut A-A in b)

FIG. 2 shows a second embodiment of a connector 11, in particular, the first section A1 of two sections successively disposed along the longitudinal direction z. In the second embodiment, the second section A2, which is not shown and which is to be inserted into the other open end of a spacer frame, is formed for sliding/insertion into a spacer in the known manner.

In the second embodiment, the first section A1 again comprises two sub-sections, a first subsection 23 and a second sub-section 24. The two sub-sections 23, 24 have complementary wedge shapes with a wedge angle in the range of 5 to 40 degrees, preferably in the range of 10 to 20 degrees. The wedge angles of the sub-sections 23, 24 are the same. The two wedge surfaces face each other such that the outer sides of the two sub-sections 23, 24 opposite to each other are parallel, as shown in FIG. 2*b*). The two sub-sections 23, 24 are formed such that there is a distance h2 between the two outer sides opposite to each other in a first relative position. The distance may be increased by sliding the first sub-section 23 relative to the second sub-section 24 in the direction of the arrow V, i.e. by moving the distal end of sub-section 23 in the forward direction (upwards in FIG. 2*b*)) relative to sub-section 24. A locking device 25 is provided on the two wedge surfaces, comprising, in the embodiment shown, a projection 25*a* on one of the two wedge surfaces and a complementary recess 25*b* on the other of the two opposing wedge surfaces. However, gratings or knurlings may also be provided on the wedge surfaces, which result in a locking in the inserted state after the first sub-section 23 has been slid with respect to the second sub-section 24 in the direction of the arrow V. The locking device 25 is positioned such that the distance between the two outer surfaces of the first subsection 23 and the second sub-section 24 opposite to each other has a value h3 in the locked position, which corresponds to the height h1 of the spacer to be used with the connector. Teeth (not shown) are preferably provided on the outer sides of the sub-sections 23, 24 opposite to each other, which teeth advantageously become wedged to the interior wall of the spacer.

The first and second sub-sections 23, 24 may, for example, be connected to each other in a secure manner via a tape or a thin membrane, such that the two sub-sections 23, 24 are not provided as loose parts before they are inserted. The second section A2 (not shown) may be connected to the first sub-section 23 or the second sub-section 24.

Similar to the first embodiment of FIG. 1, the wedging inside the spacer is increased by a relative motion between the first sub-section and the second sub-section of the section A1 inserted into the spacer. That means, the connector is again constructed such that an external manipulation of/external application of force to (relative movement by sliding) the subsections 23, 24 in an inserted state of the first section A1, in which the first section A1 has been inserted in the space interior cavity/space 1*h* of the spacer (and before the second section A2 is fully inserted into the spacer), is enabled. The teeth are moved away from the center axis R, i.e. from a plane in the transverse direction y which includes the center axis R.

Figure 3:
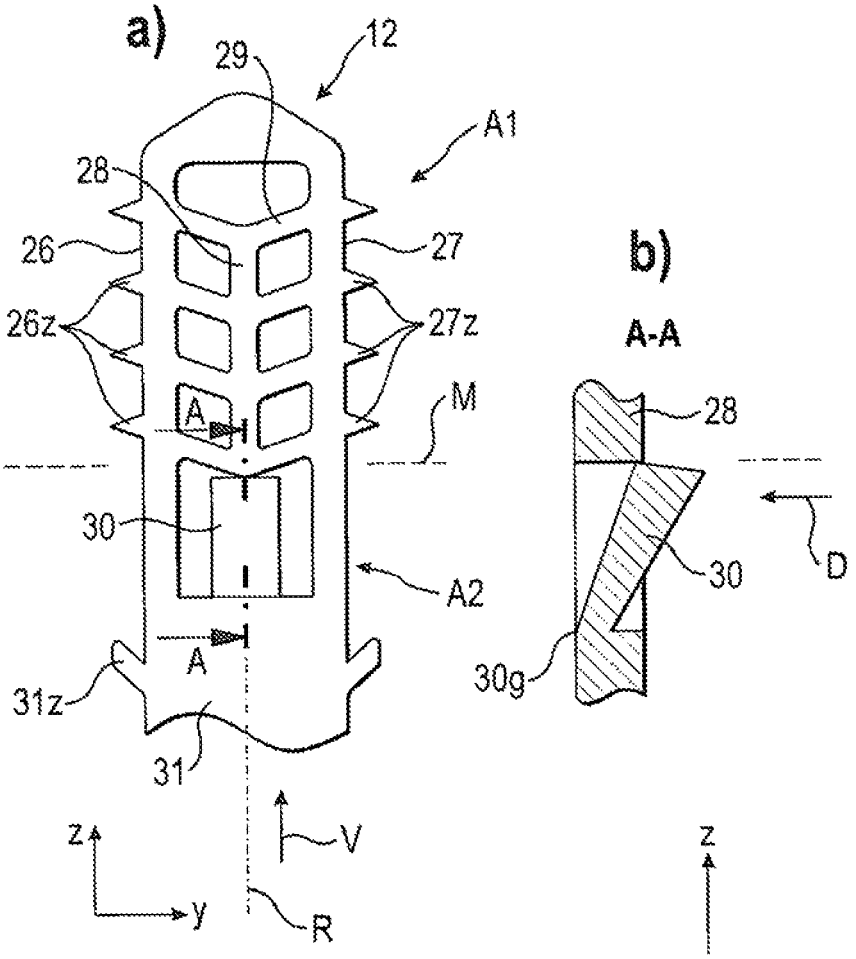
FIG. 3 shows a plan view of a third embodiment of a connector in a), and a sectional view along the cut A-A in b)

FIG. 3 shows a third embodiment of a connector 12. In FIG. 3*a*), a plan view of the connector is shown, the connector again having a first section A1 and a second section A2 successively disposed along the longitudinal direction z. The first section A1 is provided for insertion into an open end of a spacer 1. The first section has, in plan view, two side walls 26, 27 opposite to each other in the transverse direction y and having teeth 26*z*, 27*z* on their outer surfaces. In the plan view, an expansion tree 28 is provided at the center (i.e., on the center axis R), having a central stem with struts 29 which are tilted forward in the direction of insertion V of the first section A1 into the spacer 1 and extend to the outer surfaces 26, 27. The second section A2 has a form which is commonly used for insertion into a spacer and includes teeth 31*z*. A wedge 30 is connected to the body 31 of the section A2 via a flexing hinge (flector) 30*g*. The wedge 30, in a side view, protrudes from the body 31 of the second section A2 (see FIG. 3*b*)). A recess is disposed around the wedge 30, the wedge 30 extending in the longitudinal direction z from the flexing hinge 30*g* to the expansion tree 28 and being in abutment with the end of the expansion tree 28 facing towards the same. Upon insertion of the second section A2 into the other open end of a spacer 1, the wedge 30 is pressed downward in the direction of the arrow D. Thereby, the expansion tree 28 is pressed forward in the direction of the arrow V towards the tip of the section A1, whereby the struts 29 are pressed outwards, towards the respective outer surfaces 26, 27, and the teeth 26*z*, 27*z* are pressed further into the interior wall of the corresponding spacer. The inclination and/or shape of the interacting portions of the wedge 30 and the tree 28 can be adapted to the material and required movement amount. For example, a strong inclination of the outer edge of tree 28 in the cross section shown in FIG. 3*b*) could increase the movement amount.

In this embodiment, the walls 26, 27 move relative to each other via the expansion device comprising the expansion tree 28, the struts 29 and the wedge 30. Even if a spacer 1 with an inserted connector is stored for a long time, when the second section A2 is eventually inserted into the other open end of a spacer frame, the connection on the side of the section A1 is again improved.

Accordingly, in the third embodiment, an integral (integrated) expansion device is provided, which causes the two outer (side) walls 26, 27 to move relative to (away from) each other upon insertion of the second section A2 of the connector into the other open end of the spacer due to an external force applied to the wedge 30 in direction D, as shown in FIG. 3*b*). Similar to the preceding embodiments, the present connector also is constructed such that an external manipulation or external application of force to the sub-sections (side walls 26, 27) takes place after the first section A1 has been inserted into the interior cavity/space 1*h* of the spacer and before the second section A2 is fully inserted into the spacer. Thus, the teeth of side walls 26, 27 are respectively caused to be moved away (in opposite directions) from the center axis R, i.e. the two sets of teeth move away from a plane (also represented by the dashed line R in FIG. 3) that extends in the height direction x and intersects the center axis R.

Figure 4:
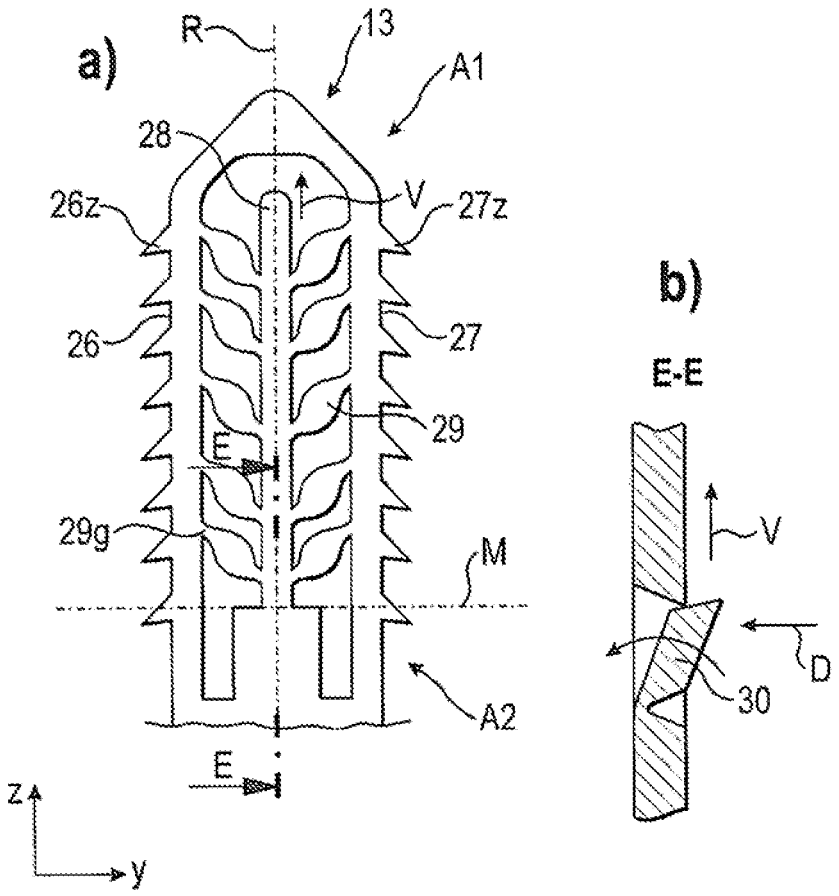
FIG. 4 shows a plan view of a fourth embodiment of a connector in a), and a sectional view along the cut E-E in b)

FIG. 4 shows a fourth embodiment of the connector 13, which is a modification of the third embodiment. Like parts are given like reference numbers. The expansion tree 28 is again only connected to the outer walls 26, 27 via the struts 29. The struts 29 have a bulgy form in a plan view and are connected to the expansion tree 28 and the associated side walls 26, 27, respectively, via comparatively thin flexing hinges 29*g*.

Figure 5:
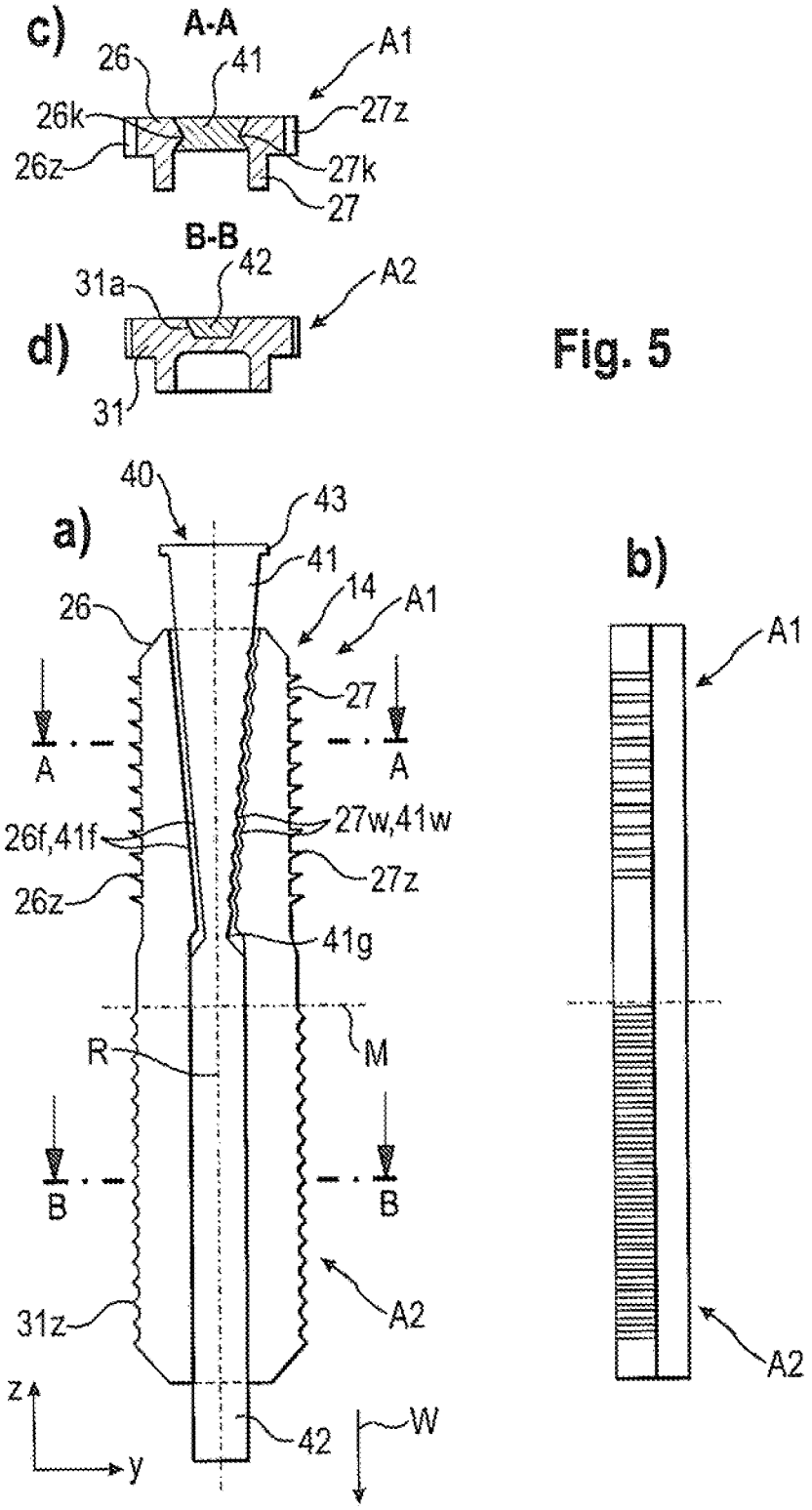
FIG. 5 shows a plan view of a connector according to a fifth embodiment in a), a side view of the connector in b), a sectional view along the line A-A of a) in c), and a sectional view along the line B-B of a) in d)

FIG. 5 shows a fifth embodiment of the connector 14. The plan view in a) and the side view in b), respectively, show the two sections A1, A2. The fifth embodiment has the two side walls 26, 27 in the first section A1 which, in this embodiment, are not connected at the tip of the section A1, but are only connected to the body of the second section A2 on the side opposite to the tip of the section A1. A space is provided between the side walls 26, 27, the space being wedged-shaped when viewed from above. The sides of the sidewalls 26, 27 defining the wedge-shaped space are convex in their across-section (see FIG. 5*c*)), i.e. convex protrusions 26*k*, 27*k* protruding into the wedge-shaped space are provided.

A recess 31*a* is provided on one side in the second section A2, which recess extends along the longitudinal direction z with a constant cross-section.

The fifth embodiment additionally includes an expansion wedge 40. The expansion wedge 40 has a wedge body 41 having a form which is complementary to the wedge-shaped space between the side walls 26, 27 on one side. In other words, the wedge angle of the wedge body 41 corresponds to the wedge angle of the wedge-shaped space, and the outer walls of the wedge body have recesses which are complementary to the convex protrusions 26*k*, 27*k*. Thereby, the wedge body 41 may be held in the wedge-shaped space. A longitudinal rail 42, the form of which is complementary to the recess 31*a*, is provided on the expansion wedge 40 adjacent to the wedge body 41. A narrowing 41*g* is provided at the transition of the wedge body 41 to the rail 42. An insertion toothing comprising teeth 31*z* is again formed on the second section A2. A stop 43 for limiting the sliding of the wedge body 41 in the direction of the arrow W is attached to the wedge body 40. The narrowing 41*g* acts as a predetermined breaking point in case the tensile force on the drawing shackle 42 is too high.

Preferably, toothings 27*w*, 41*w* for locking the position of the wedge body 41 are respectively provided on one side on the surfaces of the wedge body 41 and the side walls 26, 27 facing each other. In the embodiment shown, they are provided on the wall 27 and the opposing surface of the wedge body 41.

Upon use, the connector is inserted into a spacer up to the middle M with the first section A1 in a known manner. The teeth 26*z* and 27*z* of the toothing are again formed as an expansion toothing (similar to the first to fourth embodiments).

Before insertion of the second section A2 into the other open end of the spacer frame, the rail (drawing shackle) 42 is first drawn in the direction of the arrow W. Thereby, the wedge body 41 is drawn into the wedge-shaped space, and the walls 26, 27 are moved away from each other towards the outside by the wedge effect.

Again, an increase of the interlocking/wedging is achieved (through the external force applied to the expansion wedge 40) by a relative motion of the two sub-sections 26, 27, either at the manufacturer of the spacer or immediately before the second section A2 is inserted into the other open end of the spacer 1 at the manufacturer of the window. Again, the connector is constructed such that an external manipulation of/external application of force to (relative movement by pushing apart) the sub-sections 26, 27 in an inserted state of the first section A1, in which the first section A1 has been inserted into the interior cavity/space 1*h* of the spacer (and before the second section A2 is fully inserted into the spacer), is enabled. As such, the teeth are moved away from the center axis R, i.e. away from a plane in the height direction x including the center axis R.

The principle of relative motion and wedging could also be reversed. Instead of a wedge-shaped space widening to the tip, a wedged-shaped spacer narrowing to the tip could be provided. The wedge body shape is complementary and pushed towards the tip instead of being pulled. As a modification, as screw-shaped wedge body interacting with a thread portion on the side walls could be used.

Figure 6:
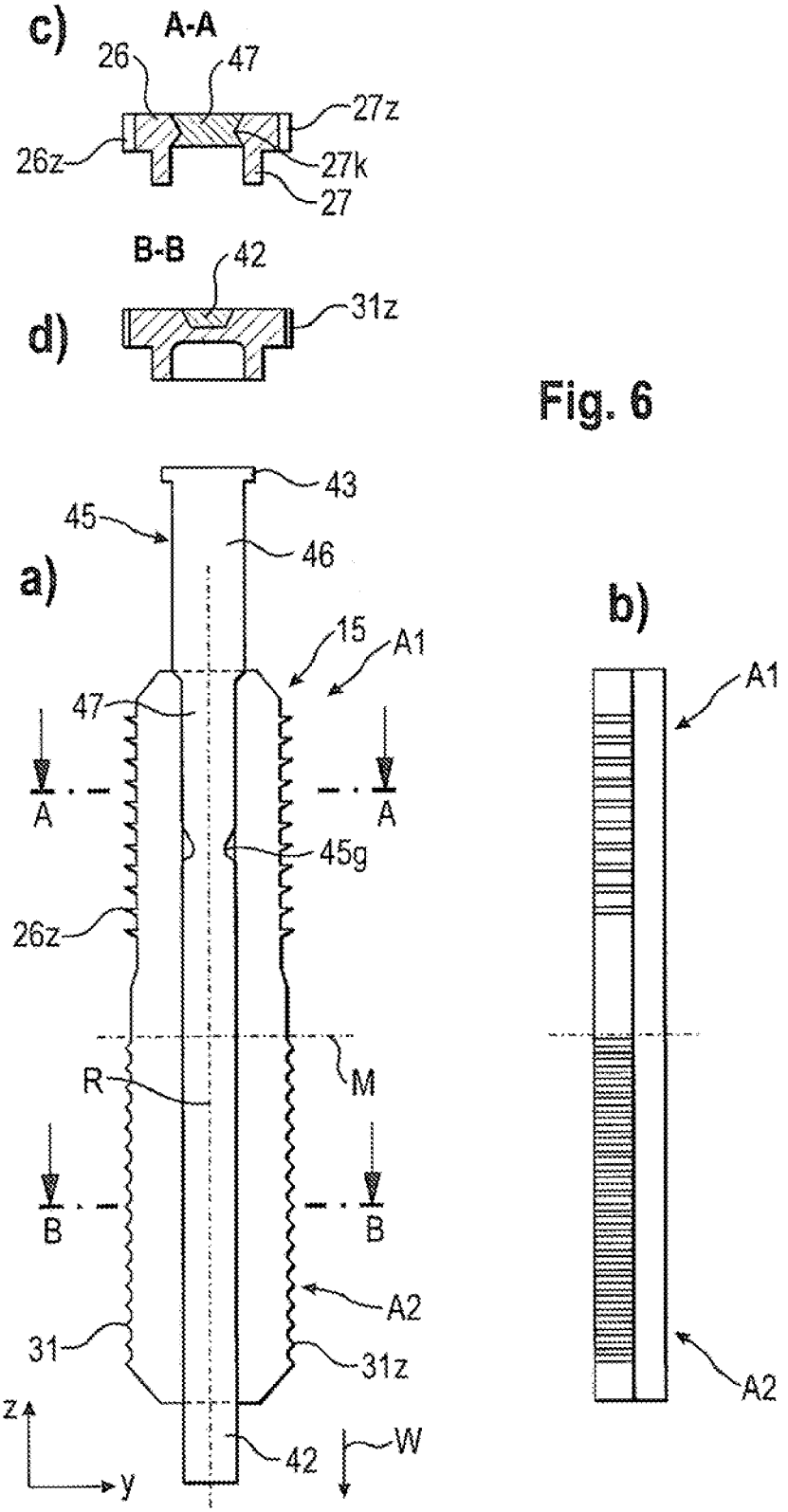
FIG. 6 shows a plan view of a connector according to a sixth embodiment in a), a side view of the connector in b), a sectional view along the line A-A of a) in c), and a sectional view along the line B-B of a) in d)

FIG. 6 shows a sixth embodiment of a connector 15. The connector 15 differs from the connector 14 in that an expansion mandrel 45 is used instead of the expansion wedge. Accordingly, the space between the sidewalls 26, 27 is not wedge-shaped, but has a longitudinal shape having substantially parallel boundaries. The wedging mandrel 45 has a mandrel body 46, 47 instead of the wedge body 41, which body in turn is connected to the rail or drawing shackle 42 via a narrowing 45*g*. Immediately adjacent to the narrowing 45*g*, the mandrel body includes a first section 47 having a first width corresponding to the distance between the side walls 26, 27 in the non-expanded position, and a second section 46 having a larger width.

According to the same principle as for the expansion wedge, the first section A1 is inserted into the open end of the spacer 1 up to the middle M by the manufacturer.

Immediately before insertion of the second section A2 into the other open end of a spacer frame, the mandrel is drawn into the space between the side walls 26, 27 by pulling the drawing shackle 42 in the direction of the arrow W, and the walls 26, 27 are expanded outwards in the same manner as in the fifth embodiment. Again, the mandrel may only be inserted up to the stop 43, and the narrowing 45*g* again serves as a predetermined breaking point for limiting the tensile force.

Similar to the second to fifth embodiments, the teeth 31*z* on the second section A2 are formed as an insertion toothing, while the teeth 26*z*, 27*z* on the first section A1 are formed as an expansion toothing.

Similar to the previous embodiments, the increased interlocking/wedging is achieved by a relative motion of two sub-sections of the first section A1. Again, the connector is constructed such that an external manipulation of/external application of force to (relative movement by pushing apart) the sub-sections 26, 27 in an inserted state of the first section A1, in which the first section A1 has been inserted into the interior cavity/space 1*h* of the spacer (and before the second section A2 is fully inserted into the spacer), is enabled.

Figure 7:
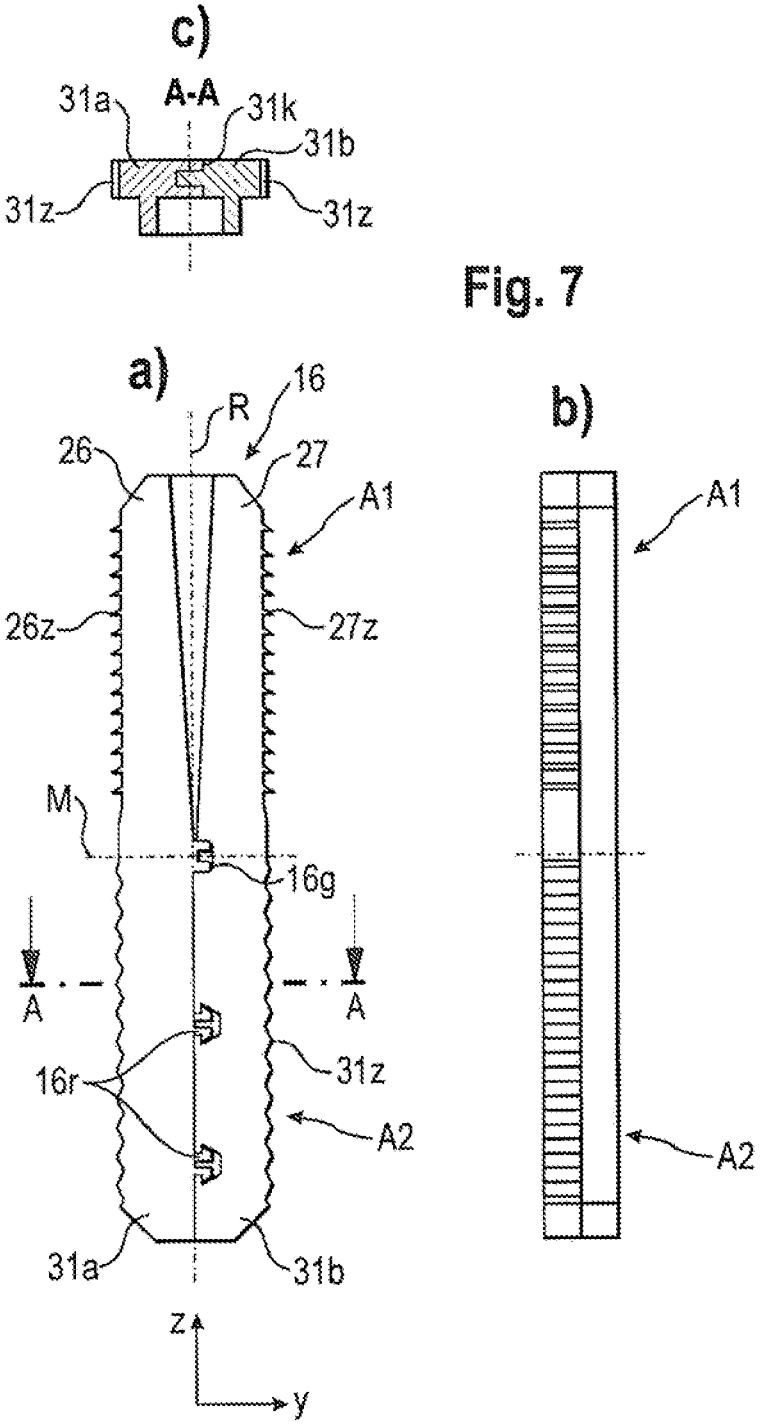
FIG. 7 shows a plan view of a connector according to a seventh embodiment in a), a side view of the connector in b), and a sectional view along the line A-A of a) in c)

The seventh embodiment shown in FIG. 7 may also be referred to as a "crocodile" connector. In the first section A1, the two side walls 26, 27 are again not connected to each other at the tip of the section A1. A hinge 16*g* is provided at the middle M between the two sections A1 and A2 (on the center axis R). A wedge-shaped space is formed between sub-sections (side walls) 26, 27 in the first section A1 from the hinge 16*g* to the tip. The second section A2 has a body 31 having two sections 31*a*, 31*b*, the relative positioning of which is assured via a contour 31*k* (see FIG. 7*c*)), and the contour 31*k* may, for example, be a recess in one of the two sections 31*a*, 31*b* and a complementary projection in the other one of the two sections 31*a*, 31*b*. The first section A1 again includes an expansion toothing 26*z*, 27*z*, while the second section A2 includes an insertion toothing 31*z*. In addition, a latching connection 16*r* is provided between the two sections 31*a*, 31*b* of the second section A2 (on the center axis R). The latching connection may also be formed as a clip connection.

Prior to assembly, the two sections 31*a*, 31*b* of the second section A2 are separated by a distance, as the two side walls 26, 27 are pivoted towards each other via the hinge 16*g*. In this state, the connector is inserted into an open end of a spacer 1 with the first section A1. When the second section A2 is to be inserted into the other open end of a bent spacer frame, the two sections 31*a*, 31*b* are pivoted via the hinge 16*g* towards each other, causing the latches 16*r* to latch. Thereby, the side walls 26, 27 are moved away from each other, and the expansion toothing 26*z*, 27*z* engages more firmly with the interior wall of the spacer 1.

As in previous embodiments, an increased interlocking/wedging is achieved by a relative motion of the sub-sections of the first section A1 already inserted into the spacer. Again, the connector is constructed such that an external manipulation of/external application of force to (relative movement by pushing apart) the sub-sections 26, 27 in an inserted state of the first section A1, in which the first section A1 has been inserted into the interior cavity/space 1*h* of the spacer (and before the second section A2 is fully inserted into the spacer), is enabled.

In the third to seventh embodiments, the walls 26, 27 are preferably formed slightly conically towards the front end of the first section A1, as shown in the figures. Thereby, the teeth disposed further toward the front end of the section A1 may be pressed into the interior wall of the spacer 1 even more firmly during the relative motion.

Figure 8:
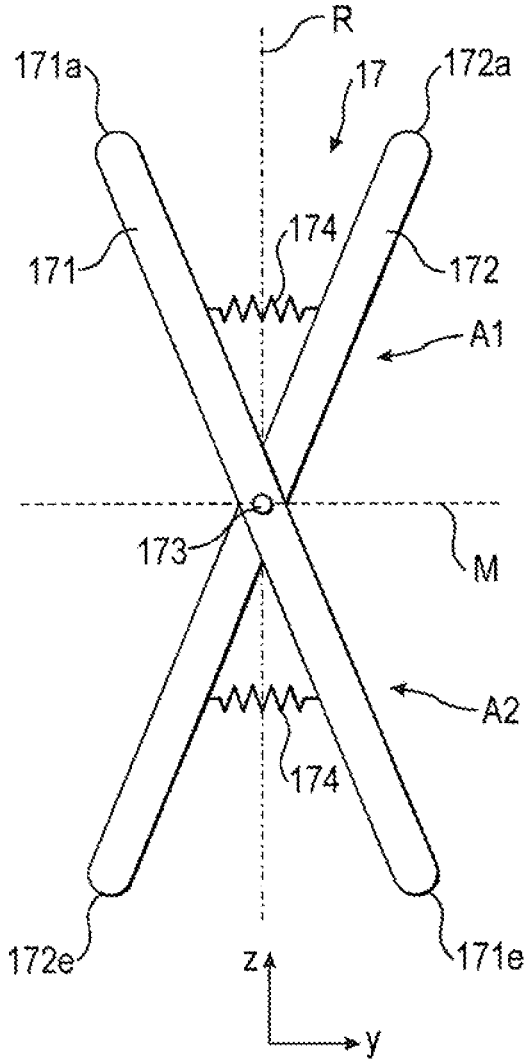
FIG. 8 shows a plan view of an eighth embodiment of a connector.

FIG. 8 shows an eighth embodiment of the connector 17. In the connector 17, two straight connector parts 171, 172 are centrally connected to each other via a hinge 173. Compression springs 174 are respectively disposed above and below the hinge between the parts 171, 172, which are disposed in the form of an X via the hinge, pressing apart the legs of the X-shape. Accordingly, the first section A1 of the connector 17 includes the sections of the parts 171, 172 disposed on one side of the hinge 173, and the second section A2 includes the other sections of the parts 171, 172. The section A1 is inserted into spacer 1 by compressing the ends 171*e*, 172*e* of the second section A2 against the compression force of the spring 174 and subsequent insertion into the open end of the spacer 1.

When the second section A2 is inserted into the other open end of the spacer frame during use of the connector 17, the ends 171*e* and 172*e* are slightly compressed. After the insertion has been completed, the connector is again pressed firmly against the interior walls by the compression force of the springs 174.

An expansion toothing (not shown) is again formed on the ends 171*a*, 172*a* of the parts 171, 172 on the side of the first section A1.

The first to eighth embodiments shown in FIGS. 1 to 8 may be formed of plastic or of metal or of a combination of plastic and metal. The embodiments implement a principle according to which the distance of the teeth from the center axis R of the spacer is increased, i.e. the teeth are pressed away from a plane which includes this center axis.

Figure 9:
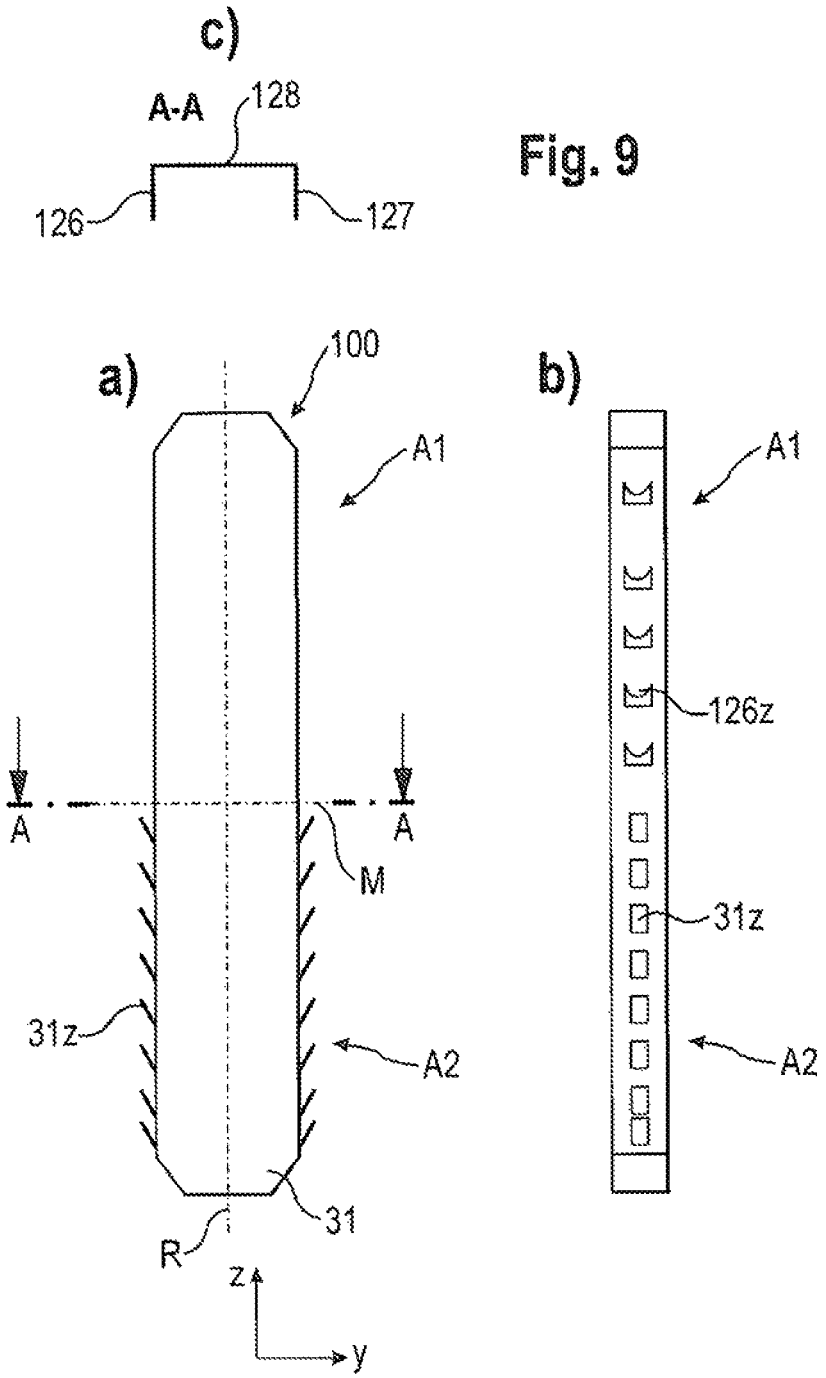
FIG. 9 shows a plan view of a connector according to a ninth embodiment in a), a side view of the connector in b), and a sectional view along the line A-A of a) in c)

FIG. 9 shows a ninth embodiment of a connector 100. As shown in FIG. 9*a*), the connector 100 again includes the first section A1 and the second section A2. The second section A2 has a conventional form with an insertion toothing 31*z* formed on the body 31.

The body 31 of the connector 100 is U-shaped, as shown in FIG. 9*c*), with a transverse wall 128 connecting the side walls 126, 127.

Pre-embossed regions for a toothing 126*z*, 127*z* are formed in the side walls 126, 127, respectively. The pre-embossed regions serve to form outwardly protruding teeth via a subsequent deformation. The ninth embodiment is either completely made of metal, or has at least the side walls made of metal.

Figure 10:
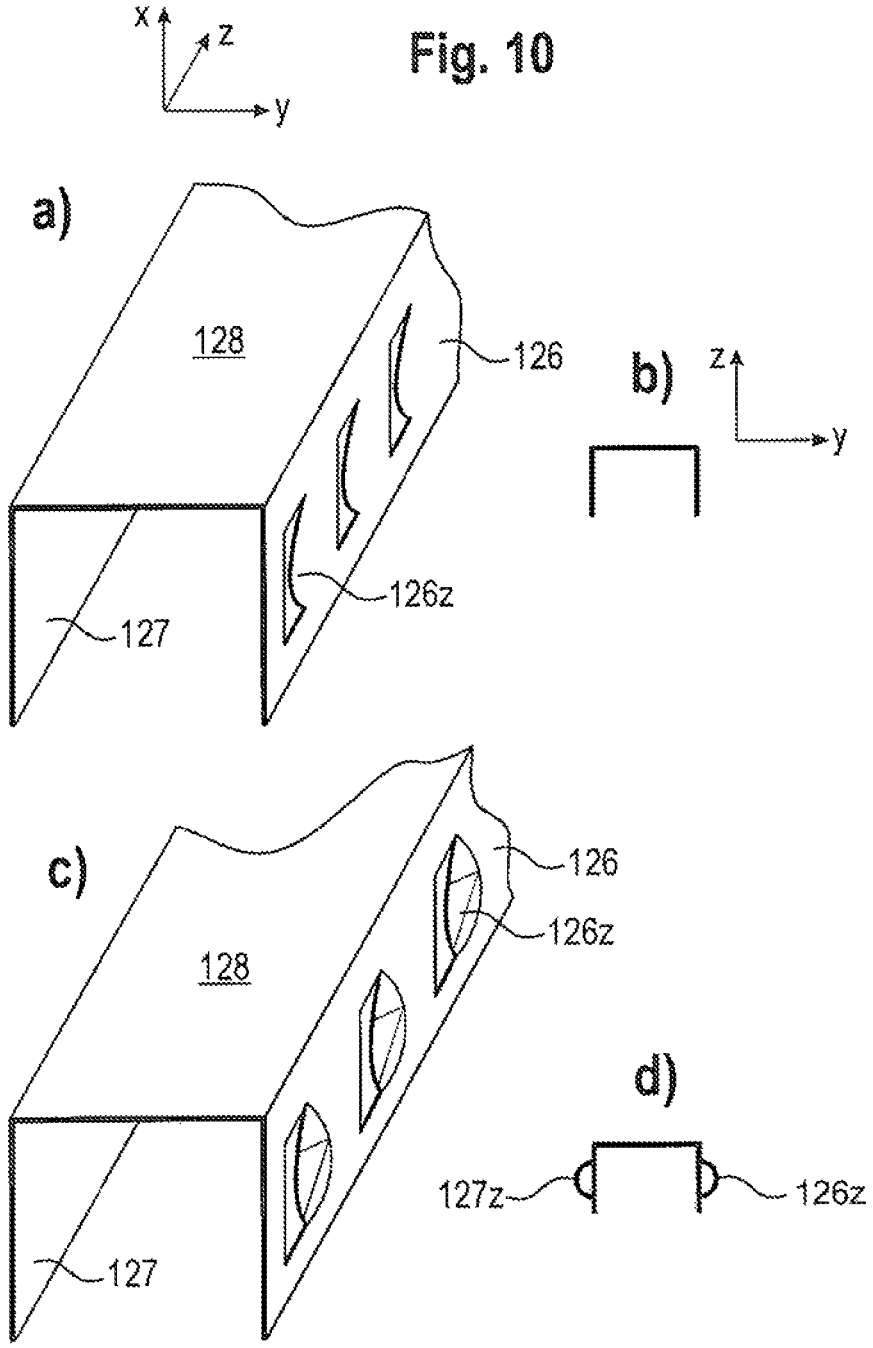
FIG. 10 shows a partial perspective view of a schematic illustration of the ninth embodiment in a) and a schematic front view in b), respectively, with teeth which are not pressed outwards, and a partial perspective view of a schematic illustration of the ninth embodiment in c) and a schematic front view in d), respectively, with teeth which are pressed outwards.

The difference between the states before and after deformation is illustrated in FIG. 10. In FIG. 10*a*), the section A1 having the pre-embossed regions for the toothing 126*z* is shown. It is evident from the front view in FIG. 10*b*) that the pre-embossed regions are still in the same plane as the side walls 126, 127. FIG. 10*c*) shows the state after the pre-embossed regions have been pressed outwards for forming the teeth 126*z*, 127*z*. The protrusion of the teeth 126*z*, 127*z* is clearly visible in the front view of FIG. 10*d*).

Figure 11:
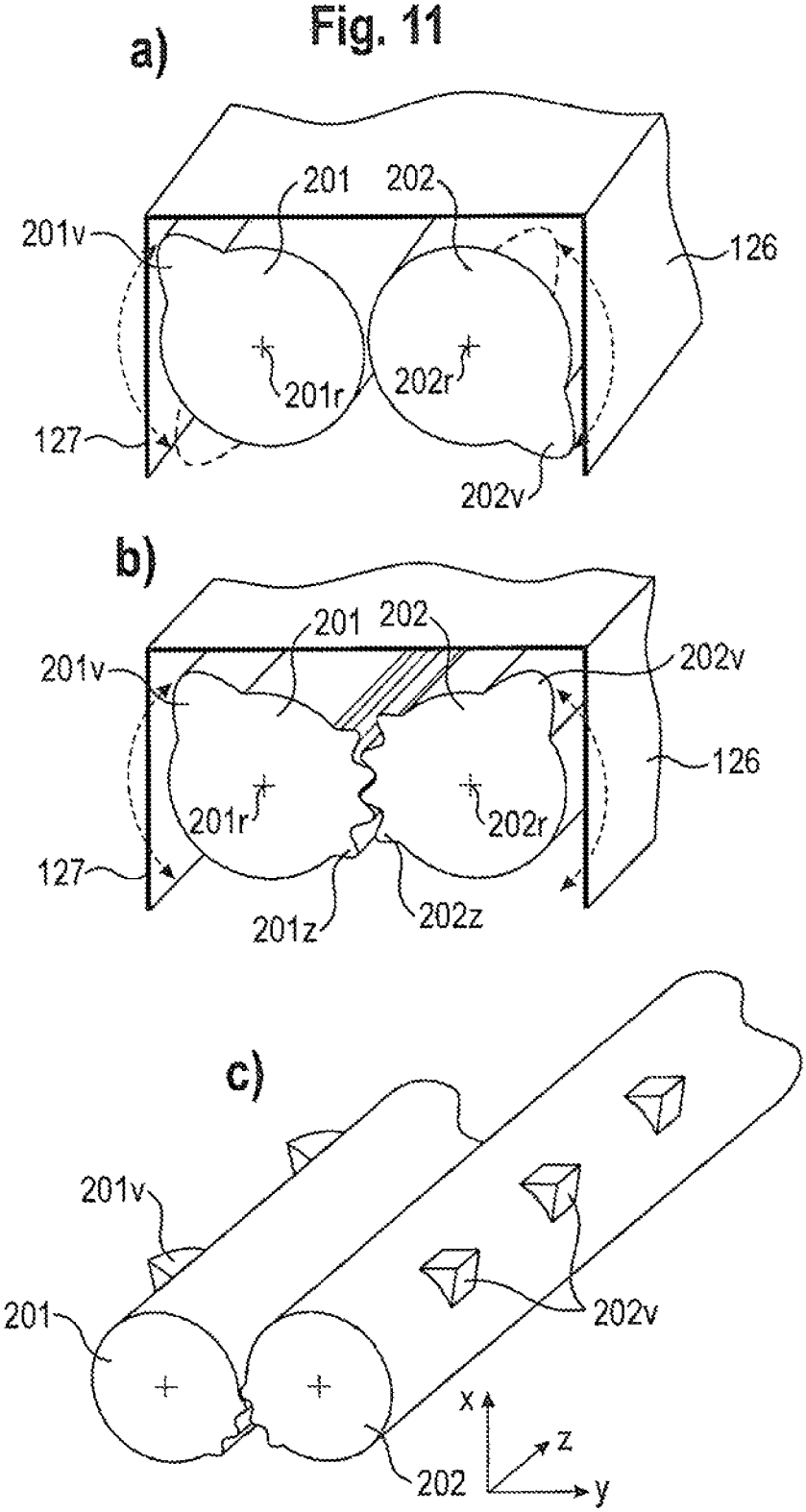
FIG. 11 shows a schematic perspective view of the connector according to the ninth embodiment with a first embodiment of an expansion tool in a position in which it is inserted into the connector in a), a schematic perspective view of the connector according to the ninth embodiment with a second embodiment of an expansion tool in a position in which it is inserted into the connector in b), and an illustration of the second embodiment of the expansion tool without the connector in c)

Such a deformation after insertion of the section A1 into the open end of a spacer 1 may, for example, be performed using the tools shown in FIG. 11. Two parallel shafts 201, 202, which are respectively rotatable with respect to parallel shaft axes 201*r*, 202*r*, include projections 201*v*, 202*v* on their outer surfaces. The two shafts 201, 202 and the projections 201*v*, 202*v*, as well as the relative arrangement of the shafts, are dimensioned such that they may be inserted between the side walls 126, 127 into the interior of the connector in the state shown in FIG. 11*a*). When the shafts 201, 202 shown in FIG. 11 are turned counter-clockwise with respect to the rotational axes 201*r*, 202*r*, as shown by the dashed lines, the projections 201*v*, 202*v* come into engagement with the pre-embossings, pressing the same outwards for forming the teeth 126*z*, 127*z*.

In an alternative embodiment of the tool, the shafts may be connected to each other via teeth 201*z*, 202*z*, such that the rotation of one shaft results in the co-rotation of the other shaft (see FIG. 11*b*)).

FIG. 11*c*) shows the two shafts with teeth and without a connector. The distance between the projections 201*v*, 202*v* on the shafts is of course chosen such that it corresponds to the distance between the pre-embossings in the corresponding side walls.

These pre-cuts/pre-embossings are disposed, e.g., at regular intervals, such that the projections 201*v*, 202*v* are also disposed at the same regular intervals.

In a further embodiment, the connector itself can be formed of two shaft-like elements corresponding to the shafts 201, 202. The shafts are kept together and in alignment, e.g. by belts or bands wound around the same and can be moved relative to each other around their axis after insertion into the spacer. The projections 201*v*, 202*v* form teeth for engaging the inner spacer wall. Preferably the shafts are hollow to allow desiccant flow. That means, the connector is constructed such that an external manipulation of/external application of force to (relative movement by rotation) the projections 201*v*, 202*v* in an inserted state of the first section A1, in which the first section A1 has been inserted into the interior cavity/space 1*h* of the spacer (and before the second section A2 is fully inserted into the spacer), is enabled.

Figure 12:
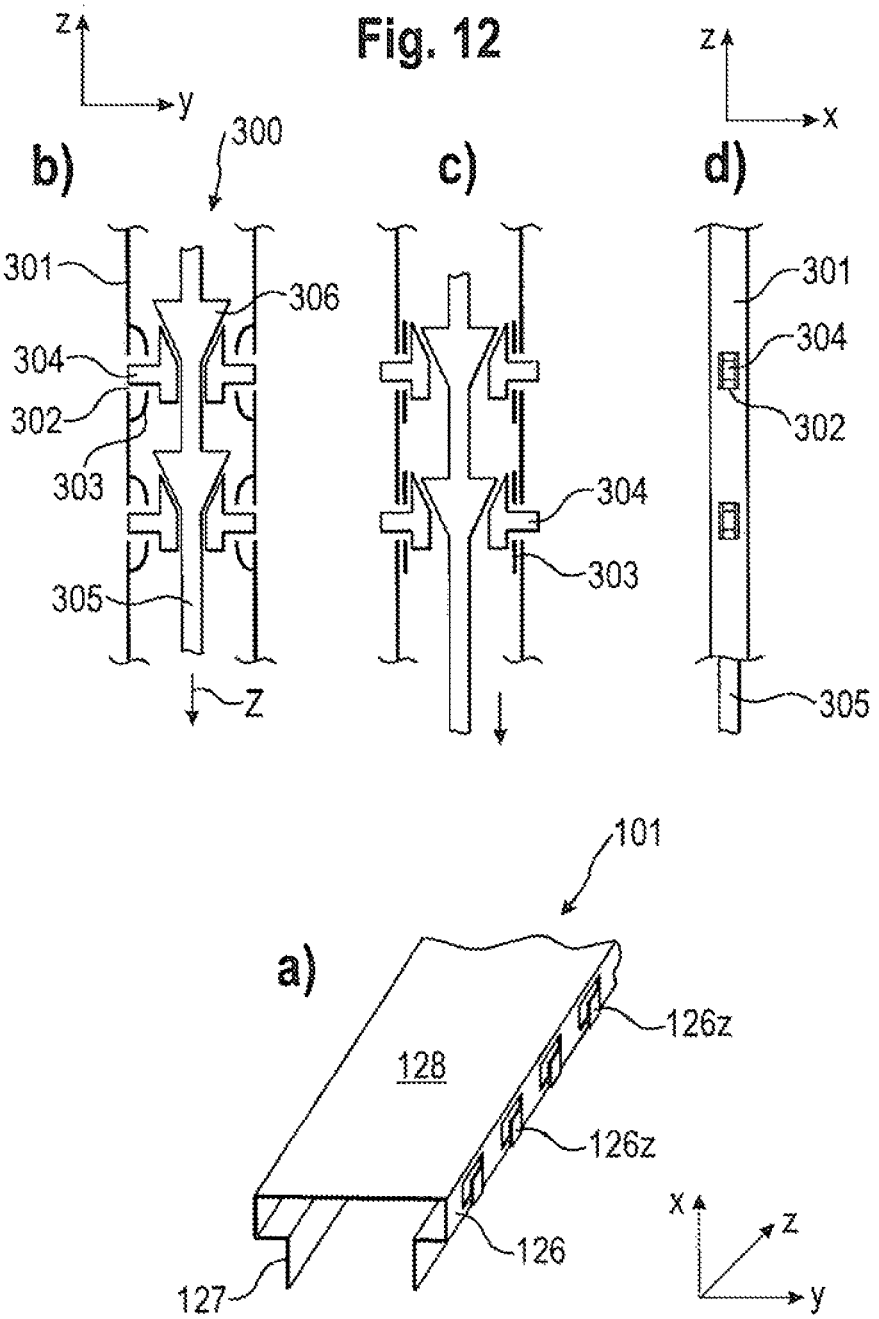
FIG. 12 shows a perspective view of a tenth embodiment of a connector in a), a plan view of an expansion tool in b) and c), and a side view of the expansion tool in d)

FIG. 12*a*) shows a tenth embodiment of a connector 101, which is essentially a modification of the ninth embodiment. The connector differs mainly in that it is not box-shaped as the connector shown in FIG. 9, but instead has a shape which is adapted for a spacer having the form shown in FIG. 1. The connector again has pre-embossed regions for forming toothings/teeth 126*z*, 127*z*.

FIGS. 12*b*), *c*), *d*) show another embodiment of an expansion tool 300. The expansion tool 300 includes an elongated box-shaped housing 301 having openings 302 on the sides. Stamping elements 304, which are biased inwards via spring elements 303, are provided behind the side openings 302, the stamping elements 304 having wedge-shaped regions facing towards the inside. At the center of the housing 301, a drawing mandrel 305 is provided, which may be drawn in the direction of the arrow Z. The drawing mandrel 305 includes wedge sections 306 which are complementary to the wedge surfaces of the stamping elements 304.

As clearly shown in FIG. 12*c*), when the drawing mandrel 305 is drawn in the direction of the arrow Z, the stamping elements 304 are pressed outwards against the force of the springs 303 and through the openings 302. In this manner, the pre-embossings for forming the teeth 126*z*, 127*z* may be pressed outwards.

In the embodiments shown in FIGS. 9 to 12, the teeth pre-formed as pre-embossings are moved relative to each other and to the connector through external manipulation/external application of force (relative movement by pushing) in an inserted state of the first section A1, in which the first section A1 has been inserted into the interior cavity/space 1*h* of the spacer (and before the second section A2 is fully inserted into the spacer)

In the above embodiment, the teeth 126*z*, 127*z* (the pre-embossings) are only provided on the sides of the connectors. However, it is understood that corresponding pre-embossings and the corresponding teeth may also be provided on the transverse wall 128 or in other positions.

In the embodiments shown in FIGS. 1 to 7, the connector is constructed such that an external manipulation of/external application of force to the connector in the inserted state of the first section A1 and before the second section A2 is inserted at all or at least before it is fully inserted in the other spacer end to be connected, causes the relative movement of the subsections. The relative movement is preferably a relative rotation or a relative sliding such as on slant/inclined surfaces such as opposed wedge surfaces, or a pushing apart in a linear or pivotable movement. The relative movement presses the teeth into the inner wall of the spacer. This also allows the use of a spike-like or intruding tooth-shape instead of a sliding tooth-shape as an additional advantage.

The same essentially applies to the embodiments shown in FIGS. 9 to 12, with the difference that the teeth as such are moved pressed and not the sub-sections carrying the same.

In all embodiments, the first section A1 and the second section A2 are symmetrical with respect to their length. In an alternative embodiment, it is also possible to use different lengths of the sections A1, A2. In such an asymmetrical configuration with respect to the middle line M, the length of the section A1 may be larger than usual. The standard length of linear connectors is limited to around 60 to 70 mm by the machines used for bending, i.e. to a length of 30 to 35 mm of the section A1 in the length direction in the symmetric configuration. The section A1 may now be formed with a length of 40 to 50 mm on one side. Thereby, more teeth come into engagement with the interior wall, and a greater extraction force may be achieved even when an insertion toothing is used.

In another embodiment, the spacer and the connector are connected in a form-fitting manner by deformation of the spacer. Preferably, a part of the wall 1*d* or a part of the wall 1*b*, which is further recessed with respect to the panes, is pressed inwards such that an inwardly-directed bulge is produced (via squeezing or chasing). The connector comprises corresponding recesses, bulges or the like, such that the inwardly-directed bulges of the spacer may engage with the recesses of the connector.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

The invention claimed is:

1. A connector for a spacer for insulating glass units, the spacer extending in a longitudinal direction (z) with a constant cross-section in a cutting plane (x-y) perpendicular to the longitudinal direction (z) such that the spacer encloses an interior cavity, and being formed of plastic at least on an inner side enclosing the interior cavity, the connector comprising:

a first connector section configured to be inserted into the interior cavity of the spacer along the longitudinal direction (z), and a second connector section configured to be inserted into the interior cavity of the spacer along the longitudinal direction (z), wherein the first connector section and the second connector section are successively disposed along a center axis (R) extending in the longitudinal direction (z), the first connector section is configured to be held in the interior cavity of the spacer by contact with the inner side of the spacer after insertion, first teeth are disposed on a first outer surface of the second connector section, second teeth are disposed on a second outer surface of the second connector section and the first outer surface is opposite of the second outer surface, the first connector section includes two sub-sections that are moveable relative to each other, each of the two sub-sections of the first connector section having teeth on an outer side of the sub-sections, and the first and second connector sections are configured such that the two sub-sections of the first connector section are capable of receiving an external force when the first connector section has been inserted into the interior cavity such that at least some of the teeth, or portions of the teeth, of the first connector section are moved away from a plane that includes the center axis (R) in response to a relative motion produced by the external force while a spacing between the first and second teeth of the second connector section does not change as the result of the application of the external force.

2. The connector according to claim 1, wherein:

the two sub-sections of the first connector section are rotatable relative to each other, each of the two sub-sections of the first connector section has a dimension (b1, b2) greater than a height (h1) of the interior cavity in the cutting plane (x-y) perpendicular to the center axis (R) in at least one direction, and the two sub-sections are lockable relative to each other in a rotated position.

3. The connector according to claim 2, wherein at least one of the two sub-sections has an oval cross-section in the cutting plane (x-y) perpendicular to the center axis (R).

4. The connector according to claim 3, wherein the teeth of the first connector section are configured to form a spike connection with the inner side of the spacer upon movement of the teeth away from the plane that includes the center axis (R).

5. The connector according to claim 4, wherein the first and second teeth defined on the second connector section are configured to form a connection with the inner side of the spacer upon insertion.

6. The connector according to claim 1, wherein the two sub-sections of the first connector section each have a wedge shape with a wedge surface, the two sub-sections being moveable relative to each other along the wedge surfaces and having a locking mechanism for locking with each other in a moved position.

7. The connector according to claim 6, wherein the locking mechanism includes latching means for locking the two sub-sections in the moved position.

8. The connector according to claim 7, wherein the teeth of the first connector section are configured to form a spike connection with the inner side of the spacer upon movement of the teeth away from the plane that includes the center axis (R).

9. The connector according to claim 8, wherein the first and second teeth defined on the second connector section are configured to form a connection with the inner side of the spacer upon insertion.

10. The connector according to claim 1, wherein:

the first connector section is configured to be inserted into a first longitudinal end of the spacer and the second connector section is configured to be inserted into a second longitudinal end of the spacer, the two sub-sections of the first connector section are first and second side walls, the teeth of the first connector section being respectively defined on outer sides of the first and second side walls, and the connector further includes an expansion device configured to move the first and second side walls of the first connector section apart from each other in opposite directions away from the center axis (R).

11. The connector according to claim 10, wherein the expansion device includes an integral expansion tree or an expansion wedge configured to press apart the first and second side walls.

12. The connector according to claim 11, wherein the teeth of the first connector section are configured to form a spike connection with the inner side of the spacer upon expansion.

13. The connector according to claim 12, wherein the first and second teeth defined on the second connector section are configured to form a connection with the inner side of the spacer upon insertion.

14. The connector according to claim 10, wherein the expansion device includes:

an integral expansion tree located in the first connector section and comprising a central stem extending along the center axis and a plurality of struts respectively connecting the center stem to the first and second side walls, and an integral expansion wedge connected to a body of the second connector section via a hinge, the expansion wedge being configured to be pressed by the inner side of the spacer upon insertion of the second connector section into the interior cavity of the spacer into contact with the central stem to thereby push the plurality of struts and cause the first side wall to move away from the second side wall.

15. The connector according to claim 14, wherein the teeth of the first connector section are configured to form a spike connection with the inner side of the spacer upon expansion.

16. The connector according to claim 15, wherein the first and second teeth defined on the second connector section are configured to form a connection with the inner side of the spacer upon insertion.

17. The connector according to claim 10, wherein the expansion device includes an expansion mandrel configured to press apart the first and second side walls.

18. The connector according to claim 1, wherein the first and second connector sections are configured such that, when the two sub-sections have been moved to a moved position away from the plane that includes the center axis by the corresponding relative movement, at least some of the teeth of the two sub-sections wedge into the inner side of the spacer in the moved position while full insertion of the first and second teeth of the second connector section into the spacer still remains possible in the moved position of the two sub-sections of the first connection section.

19. The connector according to claim 1, wherein the external force includes a linear component that is not perpendicular to the plane.

20. An assembly comprising:

a spacer for insulating glass units, said spacer extending in a longitudinal direction (z) with a constant cross-section in a cutting plane (x-y) perpendicular to the longitudinal direction (z) such that the spacer encloses an interior cavity, and being formed of plastic at least on the inner side enclosing the interior cavity and including a metal diffusion barrier layer outward of the interior cavity, and a connector inserted into the interior cavity at an open end of the spacer, the connector comprising:

a first connector section inserted into the interior cavity of the spacer along the longitudinal direction (z), and a second connector section configured to be inserted into the interior cavity of the spacer along the longitudinal direction (z), wherein the first connector section and the second connector section are successively disposed along a center axis (R) extending in the longitudinal direction (z), the first connector section is held in the interior cavity of the spacer by contact with the inner side of the spacer after insertion, the first connector section includes two sub-sections that are moveable relative to each other, each of the two sub-sections having teeth on an outer side of the sub-section, and the two sub-sections are capable of receiving an external force when the first connector section has been inserted into the interior cavity such that at least some of the teeth are moved away from a plane that includes the center axis (R) in response to a relative motion produced by the external force.

21. A connector for a spacer for insulating glass units, the spacer extending in a longitudinal direction (z) with a constant cross-section in a transverse plane (x-y) that is perpendicular to the longitudinal direction (z) such that an interior cavity is defined within spacer, wherein at least an inner side of the spacer facing the interior cavity is composed of plastic, the connector comprising:

a first connector section configured to be inserted into the interior cavity of a first longitudinal end of the spacer along the longitudinal direction (z), and a second connector section configured to be inserted into the interior cavity of a second longitudinal end of the spacer along the longitudinal direction (z), wherein the first connector section and the second connector section are successively disposed along a center axis (R) extending in the longitudinal direction (z), first teeth are disposed on a first outer surface of the second connector section, second teeth are disposed on a second outer surface of the second connector section and the first outer surface is opposite of the second outer surface, the first connector section includes first and second sub-sections, each having teeth on their respective outer sides that are configured to contact and wedge into the inner side of the spacer, and the first and second sub-sections are configured to move away from each other, while the first connector section is located within the interior cavity of the spacer, such that at least some of the teeth, or portions of the teeth, of the first connector section move away from a plane that intersects the center axis (R) as the result of the application of a linear external force in the longitudinal direction (z) that is applied to the second connector section and that acts within the plane while a spacing between the first and second teeth of the second connector section does not change as the result of the application of the linear external force.

* * * * *